US005339229A

United States Patent [19]

Snyder

[11] Patent Number: 5,339,229

[45] Date of Patent: Aug. 16, 1994

[54] FLASHLIGHT ANTI-ROLL AND POSITIONING DEVICE

[76] Inventor: John J. Snyder, 25 Hall Rd., Greenville, S.C. 29609

[21] Appl. No.: 113,180

[22] Filed: Aug. 30, 1993

[51] Int. Cl.[5] ..... F21L 15/18

[52] U.S. Cl. ..... 362/208; 362/190; 362/457

[58] Field of Search ..... 362/190, 191, 202, 208, 362/298, 457

[56] References Cited

U.S. PATENT DOCUMENTS

| | | | |
|---|---|---|---|
| D. 321,062 | 10/1991 | Bonbright | D26/140 |
| D. 324,109 | 2/1992 | Caridi | D26/140 |
| 1,934,214 | 11/1933 | Stimson | 362/208 |
| 2,309,687 | 2/1943 | Wood | 362/208 |
| 2,489,806 | 11/1949 | Oliver | 362/208 |
| 3,539,800 | 11/1970 | Doring | 240/52.15 |
| 4,220,304 | 9/1980 | Wong et al. | 362/398 |
| 4,506,317 | 3/1985 | Duddy | 362/369 |
| 4,881,155 | 11/1989 | Gahagan | 362/191 |
| 5,165,782 | 11/1992 | Maglica et al. | 362/208 |

*Primary Examiner*—Richard R. Cole

*Attorney, Agent, or Firm*—Rhodes & Ascolillo

[57] ABSTRACT

A positioning device for a flashlight and the like having a substantially cylindrical body portion, the positioning device including an annular member having an interior opening passing therethrough, the interior opening being dimensioned to at least partially encircle the substantially cylindrical body of the flashlight, the annular member having an exterior surface opposing the interior opening, and at least one substantially planar surface provided on the exterior surface of the annular member. Preferably, the annular member includes a magnetized plastic material, and the at least one substantially planar surface includes at least six substantially planar surfaces provided on the exterior surface of the annular member, or the at least one substantially planar surface includes at least five substantially planar surfaces provided on the exterior surface of the annular member.

9 Claims, 1 Drawing Sheet

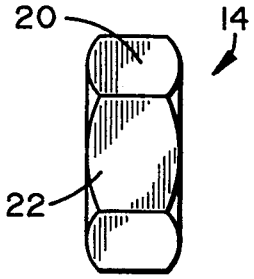
FIG. 5
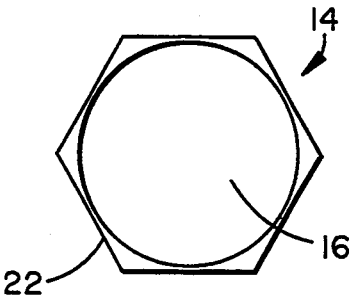
FIG. 6
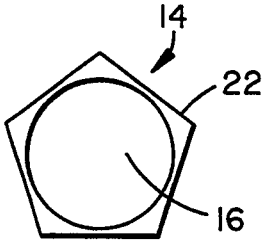
FIG. 7
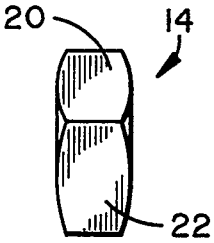
FIG. 8
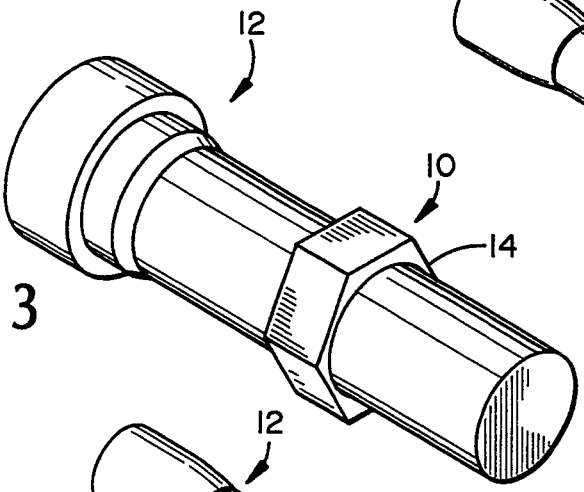
FIG. 3
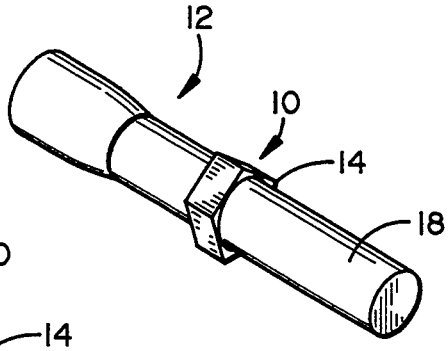
FIG. 4
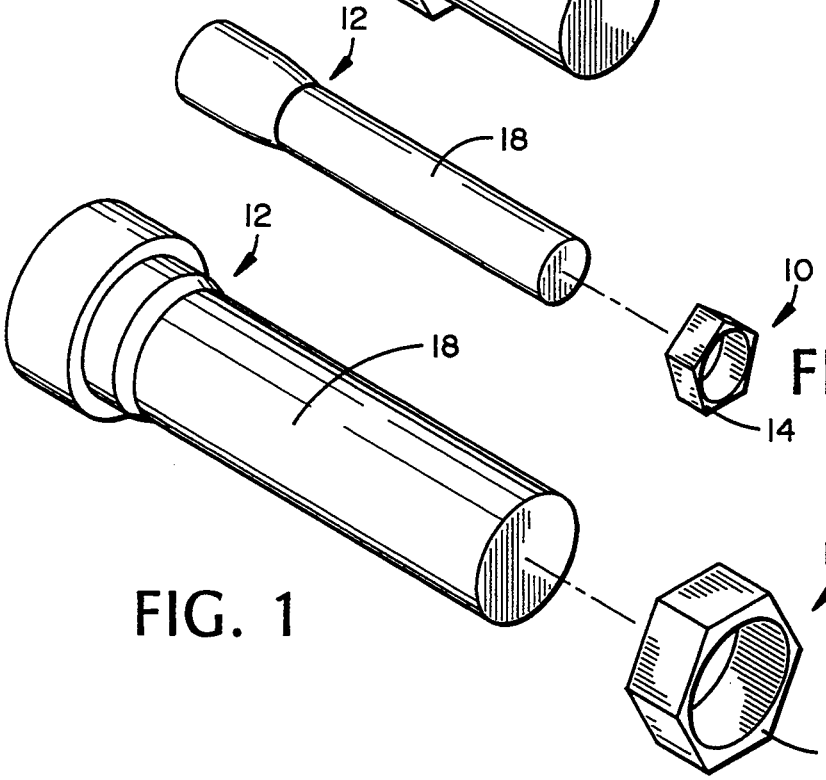
FIG. 2
FIG. 1

FLASHLIGHT ANTI-ROLL AND POSITIONING DEVICE

BACKGROUND

1. Field of the Invention

The present invention relates to the field of positioning devices, most particularly, devices intended for aftermarket attachment to flashlights and the like.

2. Description of the Related Art

U.S. Pat. No. 4,881,155 relates to a multipurpose safety and utility flashlight having a clip by which it can be attached to a user and also having an outwardly extending flashlight bulb which projects a hemispherical beam pattern.

U.S. Pat. No. 4,506,317 relates to a service light for motor vehicle use and the like having a magnetic base attachable to an iron-containing object for support, a C-shaped resilient clamp support for a flashlight, and an elongated arm connecting the base with the clamp.

U.S. Pat. No. 3,539,800 relates to a magnet assembly for detachably attaching a flashlight to a surface, the magnet assembly being hidden when not in use and partially protruding from the flashlight when positioned near a magnet attracting surface.

U.S. Pat. No. De. 324,109 relates to an ornamental design for a magnetic flashlight holder.

U.S. Pat. No. De. 321,062 relates to an ornamental design for a flexible holder with magnetic base and clamp for a small flashlight and the like.

SUMMARY OF THE INVENTION

Flashlights are commonly employed in emergency situations where some sort of repair is being made. Therefore, one frequently wishes to place a flashlight in a stationary position where it will illuminate a particular area, thereby leaving both hands free to effect the desired repair. However, a great number, if not a majority of flashlights are manufactured in a cylindrical barrel shape. When placed on a flat surface, such as a table, such flashlights have a pronounced tendency to roll out of the desired position.

Accordingly, one object of the present invention is the provision of an anti-roll and positioning device that can be attached to a flashlight or the like that has a substantially cylindrical body and that will substantially prevent, or at least minimize, the tendency of the flashlight to roll out of a position in which it has been placed.

Another object of the invention is the provision of an anti-roll and positioning device that can be attached to a flashlight or the like with a minimum of effort.

Yet another object of the invention is the provision of an anti-roll and positioning device that will simultaneously permit the flashlight to be even more positively positioned on ferrous objects.

A further object of the invention is the provision of such an anti-roll and positioning device in at least two versions, one version for flashlights of relatively large size, and one version for flashlights of smaller dimensions.

A still further object of the invention is the provision of such an anti-roll and positioning device that is simple in construction and operation and that can, therefore, be inexpensively fabricated.

In one aspect, the invention generally features a positioning device for a flashlight and the like having a substantially cylindrical body portion, the positioning device including: an annular member having an interior opening passing therethrough; the interior opening being dimensioned to at least partially encircle the substantially cylindrical body of the flashlight; the annular member having an exterior surface opposing the interior opening; and at least one substantially planar surface provided on the exterior surface of the annular member.

Preferably, the annular member includes a magnetized plastic material; and the at least one substantially planar surface includes at least six substantially planar surfaces provided on the exterior surface of the annular member; or the at least one substantially planar surface includes at least five substantially planar surfaces provided on the exterior surface of the annular member.

In another aspect, the invention generally features a positioning device for a flashlight and the like having a substantially cylindrical body portion, the positioning device including: an annular member having an interior opening passing therethrough; the interior opening being dimensioned to at least partially encircle the substantially cylindrical body of the flashlight; the annular member having an exterior surface opposing the interior opening; and at least six substantially planar surface provided on the exterior surface of the annular member; the six substantially planar exterior surfaces being spaced substantially equally about the exterior surface of the annular member.

Preferably, the annular member includes a magnetized plastic material; the six substantially planar surfaces are all substantially identical in configuration when viewed in plan; and the exterior surface of the annular member includes a hexagonal configuration when viewed in elevation.

In another aspect, the invention generally features a positioning device for a flashlight and the like having a substantially cylindrical body portion, the positioning device including: an annular member having an interior opening passing therethrough; the interior opening being dimensioned to at least partially encircle the substantially cylindrical body of the flashlight; the annular member having an exterior surface opposing the interior opening; and at least five substantially planar surface provided on the exterior surface of the annular member, the five substantially planar exterior surfaces being spaced substantially equally about the exterior surface of the annular member.

Preferably, the annular member includes a magnetized plastic material; the six substantially planar surfaces are all substantially identical in configuration when viewed in plan; and the exterior surface of the annular member includes a pentagonal configuration when viewed in elevation.

The invention will now be described by way of a particularly preferred embodiment, reference being made to the accompanying drawings, wherein:

BRIEF DESCRIPTION OF THE DRAWINGS

FIG. 1 is a perspective view of a first embodiment of an anti-roll and positioning device constructed according to the present invention, shown in conjunction with a flashlight to which the anti-roll and positioning device is to be attached;

FIG. 2 is a perspective view of a second embodiment of an anti-roll and positioning device constructed according to the present invention, shown in conjunction with a flashlight to which the anti-roll and positioning device is to be attached;

FIG. 3 is a perspective view of the first embodiment of the anti-roll and positioning device attached to the flashlight;

FIG. 4 is a perspective view of the second embodiment of the anti-roll and positioning device attached to the flashlight;

FIG. 5 is a side elevational view of the first embodiment of the anti-roll and positioning device;

FIG. 6 is a front elevational view of the first embodiment of the anti-roll and positioning device;

FIG. 7 is a front elevational view of the second embodiment of the anti-roll and positioning device; and FIG. 8 is a side elevational view of the second embodiment of the anti-roll and positioning device.

DESCRIPTION OF THE PREFERRED EMBODIMENT

Referring initially to FIGS. 1, 3, 5, and 6, a first embodiment of an anti-roll and positioning device 10 constructed according to the present invention is designed for attachment to a flashlight 12, the flashlight 12 being of relatively large size. The anti-roll and positioning device 10 generally includes an annular member 14 having an opening 16 passing therethrough. Preferably, the opening 16 is of generally circular configuration when the annular member is viewed in front elevation, as shown in FIG. 6, and the opening 16 thus accommodates the insertion of a generally cylindrical barrel portion 18 of the flashlight 12 thereinto, as is seen most clearly in FIG. 3. Preferably, the opening 16 is dimensioned so as to rather snugly engage the periphery of the barrel portion 18 in a frictional fit.

The annular member 14 is preferably fabricated from a magnetized plastic material, a material which is well known in the art for its use in magnetic signs, etc. Use of a magnetized plastic material for the annular member 14 allows a flashlight fitted with the device 10 to be positively positioned on a ferrous surface by a magnetic coupling thereto, and additionally results in a relatively lightweight construction.

The annular member 14 has an exterior surface 20 opposed to the opening 16, and the exterior surface 20 is provided with at least one substantially planar surface 22 thereon. Preferably, as seen in FIGS. 1, 3, 5, and 6, the exterior surface 20 of the annular member 14 is, in the first embodiment of the invention illustrated in these figures, provided with six such planar exterior surfaces 22, the six planar exterior surfaces additionally preferably being of substantially identical configuration and equally spaced about the periphery of the annular member 14, such that the exterior surface 20 of the annular member 14 presents a hexagonal configuration when viewed in elevation, as is shown most clearly in FIG. 6.

A second embodiment of an anti-roll and positioning device constructed according to the invention that is designed for flashlights of relatively smaller dimensions is shown in FIGS. 2, 4, 7, and 8. Like reference numerals are employed below to refer to similar elements already described above, any differences in construction being specifically noted.

In this second embodiment of the invention, only five planar surfaces 22 are disposed about the exterior surface 20 of the annular member 14, all of the five planar surfaces 22 again being preferably of substantially identical configuration and equally spaced about the periphery of the annular member 14, such that the exterior surface 20 of the annular member 14 presents a pentagonal configuration when viewed in elevation, as is shown most clearly in FIG. 7. Again, the opening 16 through the annular member 14 is preferably dimensioned so as to rather snugly engage the periphery of the barrel portion 18 in a frictional fit.

The use of either five or six planar surfaces 22, depending upon the relative size of the flashlight or the like to which the device 10 is being attached, provides for better stability, particularly with smaller diameter flashlights.

With the positioning device 10 attached thereto, the flashlight 12 may nonetheless still be inserted into a holster.

While the invention has been herein described by way of a number of particular preferred embodiments, various substitutions of equivalents may be effected without departing from the spirit and scope of the invention as set forth in the following claims.

What is claimed is:

1. A positioning device for a flashlight and the like having a substantially cylindrical body portion, said positioning device comprising:

an annular member having an interior opening passing therethrough;

said interior opening being dimensioned to at least partially encircle the substantially cylindrical body of the flashlight;

said annular member having an exterior surface opposing said interior opening and said annular member comprising a magnetized plastic material; and at least one substantially planar surface provided on said exterior surface of said annular member.

2. A positioning device according to claim 1, wherein said at least one substantially planar surface comprises at least six substantially planar surfaces provided on said exterior surface of said annular member.

3. A positioning device according to claim 1, wherein said at least one substantially planar surface comprises at least five substantially planar surfaces provided on said exterior surface of said annular member.

4. A positioning device for a flashlight and the like having a substantially cylindrical body portion, said positioning device comprising:

an annular member having an interior opening passing therethrough;

said interior opening being dimensioned to at least partially encircle the substantially cylindrical body of the flashlight;

said annular member having an exterior surface opposing said interior opening and said annular member comprising a magnetized plastic material; and at least six substantially planar surfaces provided on said exterior surface of said annular member;

said at least six substantially planar surfaces being spaced substantially equally about said exterior surface of said annular member.

5. A positioning device according to claim 4, wherein said six substantially planar surfaces are all substantially identical in configuration when viewed in plan.

6. A positioning device according to claim 5, wherein said exterior surface of said annular member comprises a hexagonal configuration when viewed in elevation.

7. A positioning device for a flashlight and the like having a substantially cylindrical body portion, said positioning device comprising:

an annular member having an interior opening passing therethrough;

said interior opening being dimensioned to at least partially encircle the substantially cylindrical body of the flashlight;

said annular member having an exterior surface opposing said interior opening and said annular member comprising a magnetized plastic material; and at least five substantially planar surfaces provided on said exterior surface of said annular member;

said at least five substantially planar surfaces being spaced substantially equally about said exterior surface of said annular member.

8. A positioning device according to claim 7, wherein said six substantially planar surfaces are all substantially identical in configuration when viewed in plan.

9. A positioning device according to claim 8, wherein said exterior surface of said annular member comprises a pentagonal configuration when viewed in elevation.

* * * * *